US009402527B2

(12) United States Patent
Burkhard et al.

(10) Patent No.: US 9,402,527 B2
(45) Date of Patent: Aug. 2, 2016

(54) DISHWASHER, IN PARTICULAR DOMESTIC DISHWASHER

(71) Applicant: BSH Bosch und Siemens Hausgeräte GmbH, Munich (DE)

(72) Inventors: Andreas Burkhard, Altenmünster (DE); Daniel Delle, Bächingen (DE); Markus Gram, Augsburg (DE); Werner Haltmayer, Dinkelsbühl (DE); David Hite, New Bern, NC (US); David Schwanitz, Steinheim (DE)

(73) Assignee: BSH Hausgeräte GmbH, Munich (DE)

( * ) Notice: Subject to any disclaimer, the term of this patent is extended or adjusted under 35 U.S.C. 154(b) by 308 days.

(21) Appl. No.: 14/133,711

(22) Filed: Dec. 19, 2013

(65) Prior Publication Data

US 2014/0174569 A1 Jun. 26, 2014

(30) Foreign Application Priority Data

Dec. 21, 2012 (DE) ..... 10 2012 224 303

(51) Int. Cl.
*A47L 15/42* (2006.01)

(52) U.S. Cl.
CPC ..... *A47L 15/4217* (2013.01); *A47L 15/4251* (2013.01); *Y10T 137/8593* (2015.04)

(58) Field of Classification Search
CPC ... A47L 15/4217; D06F 39/08; D06F 39/081; D06F 38/088
See application file for complete search history.

(56) References Cited

U.S. PATENT DOCUMENTS

| | | | | |
|---|---|---|---|---|
| 3,971,540 | A * | 7/1976 | Johnson | A47L 15/4217 134/186 |
| 5,582,199 | A | 12/1996 | Schmidt et al. | |
| 8,419,864 | B2 | 4/2013 | Haltmayer et al. | |
| 2011/0036382 | A1* | 2/2011 | Ertl | A47L 15/4217 134/172 |
| 2012/0112107 | A1* | 5/2012 | Da Pont | F16K 11/24 251/129.15 |

FOREIGN PATENT DOCUMENTS

| | | | |
|---|---|---|---|
| DE | 9208712 | U1 | 8/1992 |
| DE | 10243779 | A1 | 3/2004 |

OTHER PUBLICATIONS

Machine Translation of DE10243779 by Bolduan (Mar. 25, 2004).*
Report of Examination DE 10 2012 224 303.8 dated Oct. 21, 2013.

* cited by examiner

*Primary Examiner* — Jason KO
*Assistant Examiner* — Spencer Bell
(74) *Attorney, Agent, or Firm* — Michael Tschupp; Andre Pallapies

(57) ABSTRACT

A dishwasher includes a wash container for items to be washed and configured to conduct at least water during operation, and a fluid line system having an inlet valve defined by a center line and configured for direct or indirect connection of a water inlet line from a water supply network. Disposed below the wash container is a base support having an outer wall provided with a cutout. The inlet valve is secured by a support part which is lockable in the cutout and has at least one externally open locking holder, into which the inlet valve is lockable and secured therein non-movably in an axial direction. The externally open locking holder is aligned in such a manner that the center line of an inlet of the inlet valve runs at an angle between >0° and <90° in relation to a lower face of the base support.

23 Claims, 3 Drawing Sheets

DISHWASHER, IN PARTICULAR DOMESTIC DISHWASHER

BACKGROUND OF THE INVENTION

The invention relates to a dishwasher, in particular a domestic dishwasher.

Common to conventional dishwashers, in particular domestic dishwashers, is the disadvantage that their respective inlet valves are connected to an inlet hose, which is either aligned horizontally in the region of the inlet valve so that it is low down if there is a possible kink or aligned upward in the region of the inlet valve so that it can continually discharge toward the inlet valve. Apart from possible transport and installation problems with a horizontal or approximately horizontal alignment of the inlet hose in the region of the inlet valve, it is also difficult to protect it sufficiently and in a temporally independent manner against leaked water.

BRIEF SUMMARY OF THE INVENTION

It is therefore an object of the invention to develop a dishwasher, in particular a domestic dishwasher, to obviate prior art shortcomings, in particular transport and installation problems due to the achievable hose guides for the respective inlet hose, are largely, preferably completely avoided, and to open up the possibility of an improved system for unwanted but possibly occurring leaked water.

According to one aspect of the invention, a dishwasher includes a wash container for items to be washed and configured to conduct at least water during operation, a fluid line system having at least one inlet valve, with the inlet valve having a center line and configured for direct or indirect connection of a water inlet line from a water supply network, a base support disposed below the wash container and having a lower face, with the base support having an outer wall provided with a cutout, and a support part securing the at least one inlet valve and configured for locking in the cutout, with the support part having at least one externally open locking holder, into which the at least one inlet valve is lockable and secured therein non-movably in an axial direction, the at least one externally open locking holder being aligned in such a manner that the center line of an inlet of the inlet valve runs at an angle of >0° and <90° in relation to the lower face of the base support.

Associated with the invention is the creation of a dishwasher, in particular a domestic dishwasher, which has a hose guide for the inlet hose that is advantageous in all relevant respects. The illustrated alignment of the center line of the inlet of the inlet valve means that the inlet hose runs obliquely downward in the region of the inlet valve. This hose guide prevents horizontal kinking and therefore in some instances possible progressive damage to the inlet hose; it also reduces the operating pressure present at the inlet valve and therefore the risk of a leak. The inlet hose is therefore not as low down, thereby avoiding the transport and installation problems encountered until now.

The at least one externally open locking holder is preferably configured in a locking surface of the support part that runs obliquely upward and provided below the locking surface of the support part that runs obliquely upward there is preferably a collection surface of the support part that runs obliquely downward, in which any leaked water from the inlet valve can be collected and flow away. The structural incorporation of the locking holder in a locking surface that runs obliquely upward gives the embodiment greater stability and strength for a reduced support part depth. The collection surface of the support part also generally serves to collect any leaked water in an efficient manner.

The locking surface of the support part that runs obliquely upward and the collection surface of the support part that runs obliquely downward preferably form an angle between 60° and 120°, preferably between 80° and 100°, in particular around 90°. These angle ranges are particularly advantageous when reducing the depth of the support part and any fittings.

To improve the stability and strength of the support part significantly, the locking surface of the support part that runs obliquely upward preferably forms a backward projection projecting beyond the rear face of the support part. The backward projection here is preferably closed on all sides by means of a number of backward projection surfaces.

Alternatively or additionally the collection surface of the support part that runs obliquely downward preferably has a forward projection projecting beyond the front face of the support part. This forward projection is also preferably closed on all sides by means of a number of forward projection surfaces.

For the fast and efficient collection of any leaked water the collection surface of the support part that runs obliquely downward preferably has a concave surface contour at least in parts in a horizontal direction. The at least partially concave surface contour of the collection surface of the support part brings about direct and therefore fast collection of any leaked water, regardless of the location of the leak.

Also, in particular from the point of view of managing a greater incidence of leaked water, the collection surface of the support part that runs obliquely downward is preferably enclosed at least in parts and preferably on the outside by a collection contour, it being possible for the collection contour to be configured as a raised frame that projects from the collection surface. The collection contour essentially prevents an overflow from the collection surface and ensures that it collects any leaked water reliably, even if there is a greater incidence thereof.

The collection surface of the support part that runs obliquely downward and/or the collection contour of the support part enclosing the collection surface of the support part that runs downward at least in parts and preferably on the outside preferably has a lowest collection region, in particular collection point, which can be configured as an aperture to an inner discharge surface of the support part. This preferred embodiment allows efficient, economical and reliable removal of any leaked water, as the inventive support part opens into the base support of the dishwasher on the inside. A dishwasher comprises a safety facility for leaked water in the known manner, this usually being provided in the base support of the dishwasher and also being able to be used for the described incidence of leakage. The possible difficulty until now of achieving sufficient and temporally independent protection against leaked water with a horizontal or approximately horizontal alignment of the inlet hose in the region of the inlet valve is completely avoided.

The inner discharge surface of the support part preferably has a sufficiently long discharge length, so that the collected leaked water can flow away into the interior of the known base support. This means that the presence of a safety facility for leaked water can prevent dishwasher leakage in an efficient and economical manner.

Also the locking surface of the support part that runs obliquely upward and the collection surface of the support part and any adjoining surfaces of the support part that runs obliquely downward are preferably enclosed at least in parts by a frame, which can be locked by means of at least one locking contour into the cutout introduced into the outer wall of the base support. The frame improves the stability and strength of the support part even more significantly and also ensures the secure positioning of the support part on the base support of the dishwasher even in the most difficult operating conditions.

The locking contour of the frame here is preferably positioned in a lower frame part and the further edge regions of the frame are preferably provided, at least in parts, with stop contours for outside contact with the cutout introduced into the outer wall of the base support. The combination of locking contour and multiple stop contours offers the advantage of fast, reliable and screwless assembly of the support part on the base support. This provides the best conditions for efficient line assembly of the components.

The at least one externally open locking holder of the support part for securing the inlet valve preferably has an opening to receive the inlet valve at the top, a preferably yielding fixing contour for the inlet valve high up in each instance and a preferably yielding stop contour for the inlet valve at the bottom. This allows the inlet valve to be introduced by means of a simple linear movement into the locking holder of the support part and also to be secured there in a reliable manner. There is therefore no need for complex assembly and fastening steps.

Depending on the use of the support part either a cover part can be locked in a second externally open locking holder of the support part, said cover part preferably having at least one U-shaped, preferably peripheral groove at the edge, which can be made to engage with the fixing contours disposed on both sides and the stop contour of the locking holder, or a panel can be introduced, in particular can be injected in with a material fit, during the production of the support part. These two options allow two different support parts to be produced for very different applications essentially with the same (basic) plastic injection molding tool.

The support part is also preferably configured to secure two inlet valves, each having a center line, of a fluid line system of the dishwasher, in particular domestic dishwasher, to which at least one water inlet line from a water supply network can be connected. The use of two inlet valves, each with a water inlet, line allows a bi-thermal system to be achieved, in other words the dishwasher can be connected to both a cold water line and a hot water line.

Also a web that runs vertically and is preferably aligned centrally is preferably provided between the two externally open locking holders of the support part for securing the two inlet valves, said web projecting in particular into the main plane of the front face of the support part. Such a web has a positive impact on the stability and strength of the support part and ensures the true shape of the support part at all times by preventing any central widening of the support part during use.

BRIEF DESCRIPTION OF THE DRAWINGS

Further features and advantages of the invention will emerge from the description which follows of a number of preferred exemplary embodiments with reference to the accompanying figures, in which.

DETAILED DESCRIPTION OF EXEMPLARY EMBODIMENTS OF THE PRESENT INVENTION

Figure 1:
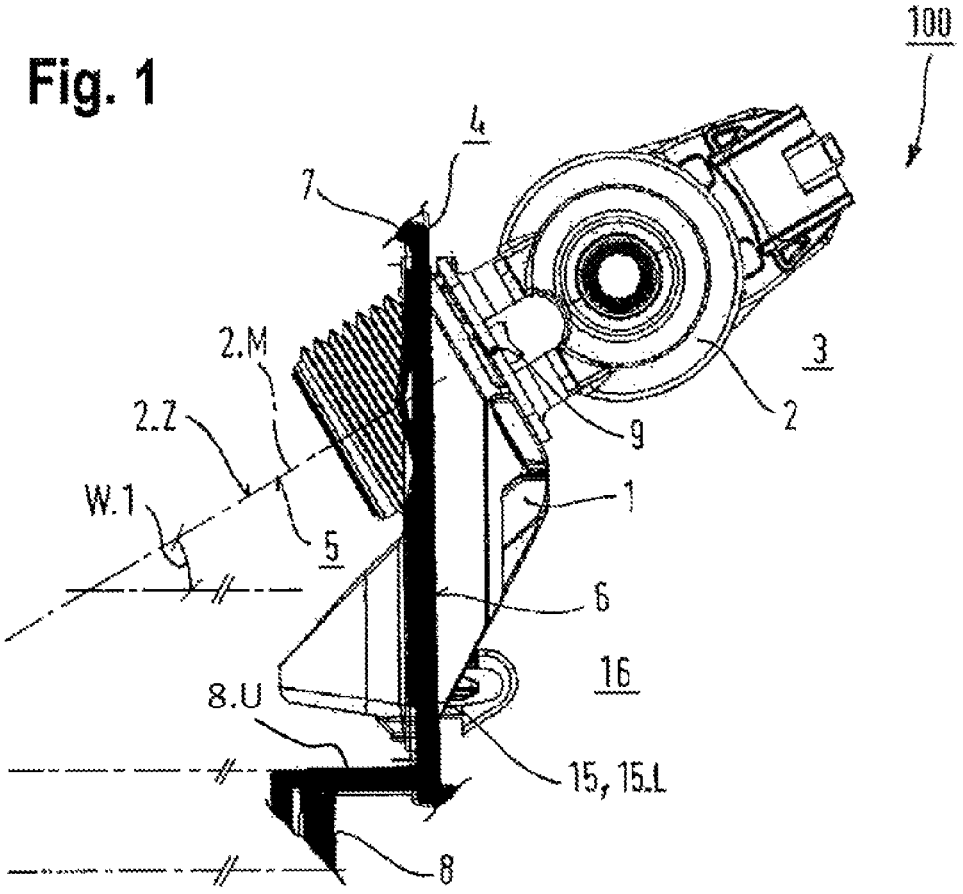
FIG. 1 shows a schematic side view of a first preferred embodiment of a support part of an inventive dishwasher with the inlet valve of a fluid line system in position.

Identical elements or components and those with the same function or action are shown with the same reference characters in the figures. Only those components of the inventive dishwasher, in particular domestic dishwasher, that are of significance for an understanding of the invention are provided with reference characters and described. Of course an inventive dishwasher, in particular domestic dishwasher, can also have other components or assemblies.

FIG. 1 shows a schematic side view of a first preferred embodiment of a support part 1 of a dishwasher 100 with an inlet valve 2 of a fluid line system 3 (not shown in detail but known to the person skilled in the art) in position.

The dishwasher 100 comprises a wash container 4 (not shown in detail) for items to be washed that conducts at least water during its operation and the support part 1 for securing at least one inlet valve 2 of a fluid line system 3, said inlet valve 2 having a center line 2.M. A water inlet line 5 (not shown in detail) from a water supply network can be connected directly or indirectly in the known manner to the fluid line system 3. The support part 1 can be locked into a cutout 6, which is provided on an outer wall 7 of a base support 8, which is disposed below the wash container 4 and has a lower face 8.U. The support part 1 also has at least one externally open locking holder 9, into which the at least one inlet valve 2 can be locked and secured therein in such a manner that it cannot be displaced axially.

The at least one externally open locking holder 9 for the at least one inlet valve 2 is now aligned in such a manner that the center line 2.M of the inlet 2.Z of the inlet valve 2 runs at an angle W.1 of >0° and <90°, preferably of ≥20° and ≤70°, in particular of ≥30° and ≤60°, to the lower face 8.U of the base support 8. The angle W.1 is shown by broken lines, which run in or parallel to the center line 2.M of the inlet 2.Z of the inlet valve 2 or the lower face 8.U of the base support 8.

Figure 2:
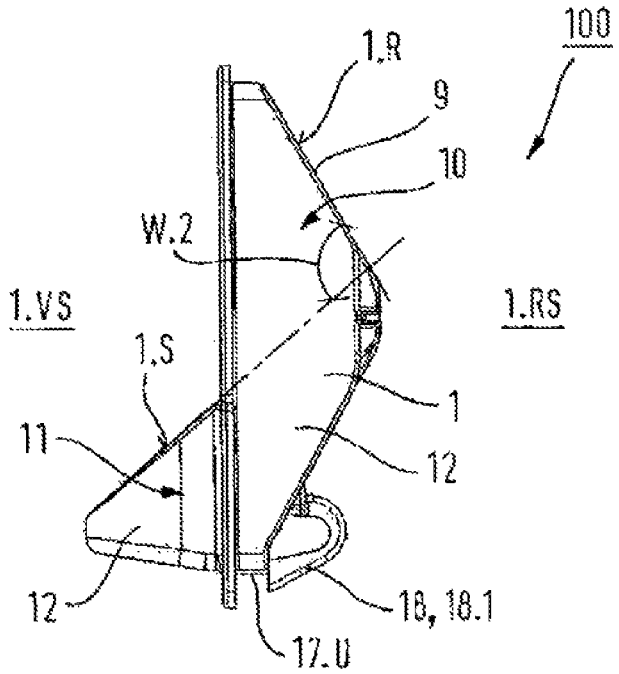
FIG. 2 shows a schematic detailed side view of the support part of the inventive dishwasher illustrated in FIG. 1.

FIG. 2 shows a schematic detailed side view of the support part 1 of the dishwasher 100 illustrated in FIG. 1.

The at least one externally open locking holder 9 is configured in a locking surface 1.R of the support part 1 that runs obliquely upward. The locking surface 1.R of the support part 1 that runs obliquely upward here forms a backward projection 10 that projects beyond the rear face 1.RS of the support part 1. In contrast a collection surface 1.S of the support part 1 that runs obliquely downward forms a forward projection 11 that projects beyond the front face 1.VS of the support part 1. The two functional surfaces 1.R, 1.S of the support part 1 form an angle W.2 between 60° and 120°, preferably between 80° and 100°, in particular around 90°. The two functional surfaces 1.R, 1.S of the support part 1 on the rear face 1.RS of the support part 1 are also preferably provided with a respective stiffening contour, in particular respective stiffening ribs. The two functional surfaces 1.R, 1.S of the support part 1 are also preferably provided with stiffening surfaces 12 at their ends.

Figure 3:
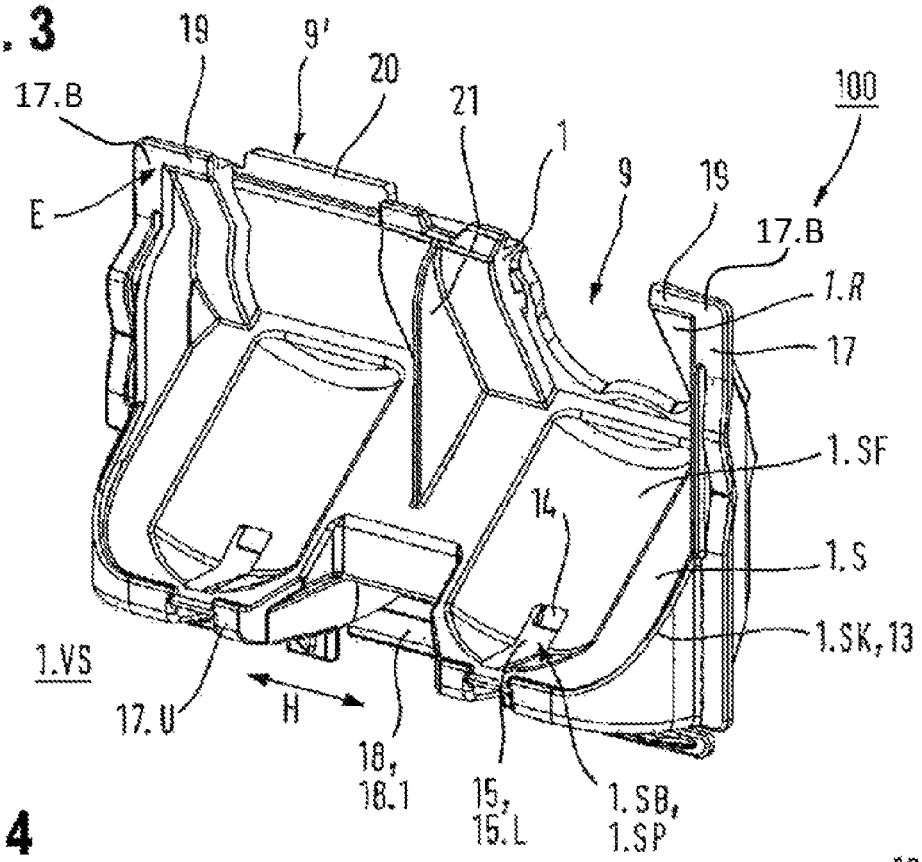
FIG. 3 shows a perspective detailed view of the support part of the inventive dishwasher illustrated in FIG. 1.

FIG. 3 shows a perspective detailed view of the support part 1 of the dishwasher 100 illustrated in FIG. 1.

The, in the present instance one, externally open locking holder 9 is, as mentioned above, configured in the locking surface 1.R of the support part 1 that runs obliquely upward. Also provided below the locking surface 1.R of the support part 1 that runs obliquely upward is the collection surface 1.S of the support part 1 that runs obliquely downward, in which any leaked water from the inlet valve 2 (see FIG. 1) can be collected and flow away.

The collection surface 1.S of the support part 1 that runs obliquely downward has a concave surface contour 1.SF in a horizontal direction H (double arrow) at least in part, in particular in its central region. The collection surface 1.S of the support part 1 that runs obliquely downward is also enclosed at least in part, in particular in a lower region and preferably on the outside, by a collection contour 1.SK, the collection contour 1.SK preferably being configured as a raised frame 13 that projects from the collection surface 1.S of the support part 1.

The collection surface 1.S of the support part 1 that runs obliquely downward and/or the collection contour 1.SK of the support part 1 enclosing the collection surface 1.S of the support part 1 that runs downward at least in part, in particular in a lower region and preferably on the outside, also comprises a lowest collection region 1.SB, in particular collection point 1.SP, which is configured as an aperture 14 to an inner discharge surface 15 of the support part 1.

The inner discharge surface 15 of the support part 1 here has a sufficiently long discharge length 15.L, so that the collected leaked water can flow away into the interior 16 (see also FIG. 1) of the base support 8.

The locking surface 1.R of the support part 1 that runs obliquely upward and the collection surface 1.S of the support part 1 and any adjoining surfaces of the support part 1 that runs obliquely downward are also enclosed at least in part by a frame 17, which can be locked by means of a locking contour 18 into the cutout 6 introduced into the outer wall 7 of the base support 8. In one preferred embodiment the locking contour 18 is a locking hook 18.1 (see also FIG. 2) positioned in a lower frame part 17.U.

The further edge regions 17.B of the frame 17 are also provided with stop contours 19 at least in parts for external contact with the cutout 6 (see FIG. 1) introduced into the outer wall 7 of the base support 8.

In the embodiment of the support part 1 illustrated in FIG. 3 a panel 20 is introduced into a second externally open locking holder 9' of the support part 1. The panel 20 can be introduced during production of the support part 1, in particular can be injected with a material fit, so that essentially no externally open locking holder 9' is configured.

Nevertheless a vertically running and preferably centrally aligned web 21 is provided between the two externally open locking holders 9, 9' of the support part 1 for securing at least one inlet valve 2, said web 21 in particular projecting into the main plane E of the front face 1.VS of the support part 1.

Figure 4:
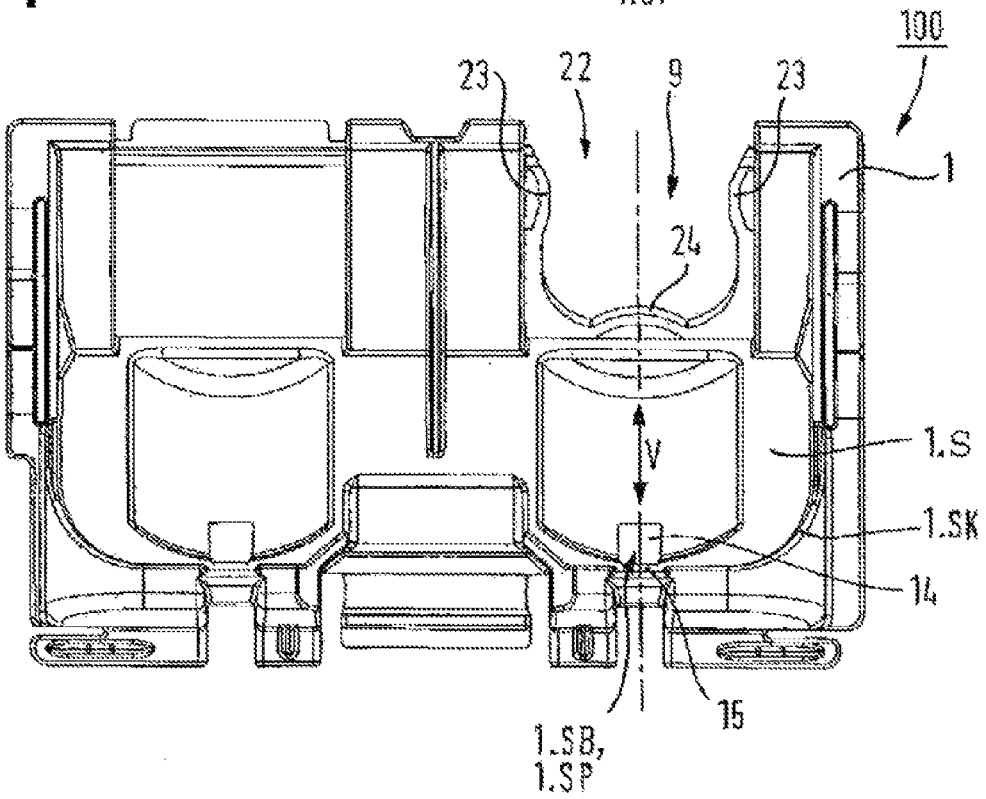
FIG. 4 shows a schematic detailed front view of the support part of the inventive dishwasher illustrated in FIG. 1.

FIG. 4 shows a schematic detailed front view of the support part 1 of the dishwasher 100 illustrated in FIG. 1.

The externally open locking holder 9 of the support part 1 for securing the inlet valve 2 (not shown) (see FIG. 1) comprises an opening 22 at the top for receiving the inlet valve, a preferably yielding fixing contour 23 for the inlet valve high up in each instance and a preferably yielding stop contour 24 for the inlet valve at the bottom. The locking holder 9 of the support part 1 therefore has a structure with mirror symmetry in respect of its central vertical plane V (double arrow).

Also clearly shown is the collection surface 1.S of the support part 1 that runs obliquely downward and/or the collection contour 1.SK of the support part 1 enclosing the collection surface 1.S of the support part 1 that runs obliquely downward at least in part, in particular in a lower region and preferably on the outside. Also provided is the lowest collection region 1.SB, in particular collection point 1.SP, which is configured as an aperture 14 to the inner discharge surface 15 of the support part 1 (see also FIG. 3).

Figure 5:
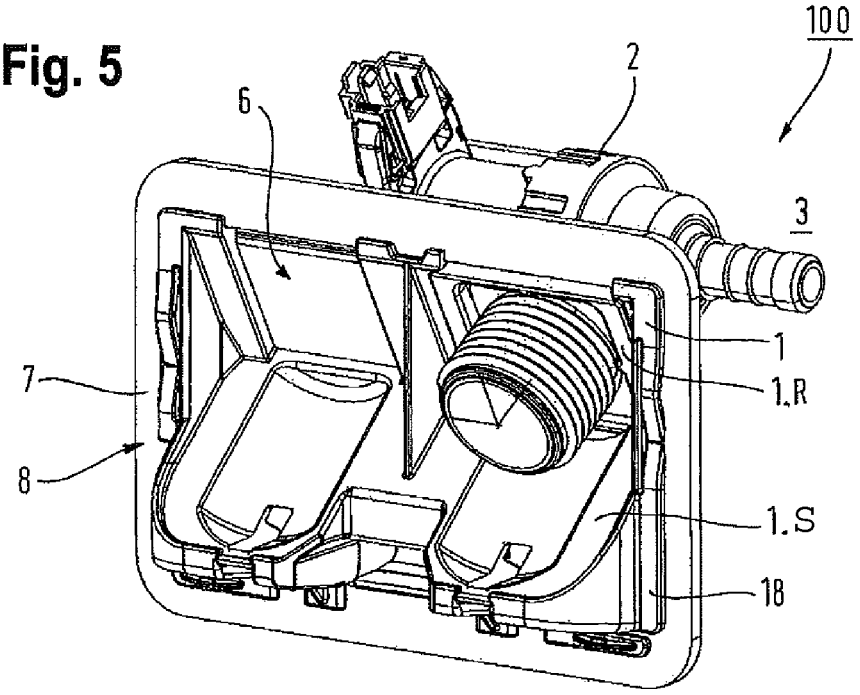
FIG. 5 shows a perspective detailed view of the support part of the inventive dishwasher illustrated in FIG. 1 with the inlet valve of a fluid line system in position.

FIG. 5 shows a perspective detailed view of the support part 1 of the dishwasher 100 illustrated in FIG. 1 with the inlet valve 2 of a fluid line system 3 in position.

The support part 1, the functional surfaces 1.R, 1.S of which are enclosed at least in parts by a frame 17, is locked by means of at least one locking contour 18 (see FIG. 2) into the cutout 6 introduced into the outlined outer wall 7 of the base support 8.

The further edge regions 17.B of the frame 17 are also provided at least in part with stop contours 19 for external contact with the cutout 6 introduced into the outlined outer wall 7 of the base support 8.

Figure 6:
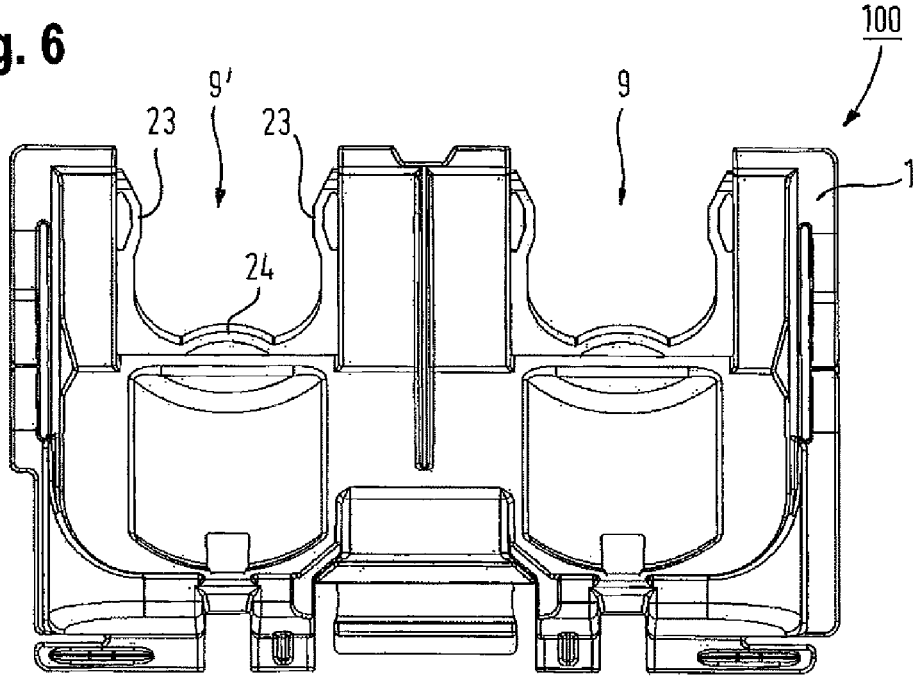
FIG. 6 shows a schematic detailed front view of a second preferred embodiment of a support part of an inventive dishwasher.

FIG. 6 shows a schematic detailed front view of a second preferred embodiment of a support part 1 of a dishwasher 100.

The illustrated support part 1 serves to secure two inlet valves 2 (not shown in detail) of a fluid line system 3 (see FIG. 1) of the dishwasher 100. The two inlet valves 2 can of course also be embodied as a double valve known to the person skilled in the art. Two externally open locking holders 9, 9' are also provided for the two inlet valves 2. Each of the two inlet valves 2 is aligned in such a manner that the respective center lines 2.M of their inlets 2.Z run at a respective angle W.1 of >0° and <90°, preferably of ≥20° and ≤70°, in particular of ≥30° and ≤60°, to the lower face 8.U of the base support 8 (see FIG. 1).

If the illustrated support part 1 is only to be used for one inlet valve 2, a cover part can be locked into the second externally open locking holder 9' of the support part 1, preferably having at least one U-shaped, preferably peripheral, groove at the edge, which can be made to engage with the fixing contours 23 disposed on both sides and the stop contour 24 of the locking holder 9'.

To summarize, it should be noted that the invention develops a dishwasher, in particular a domestic dishwasher, as known according to the preamble of the independent claim such that the problems that were encountered until now, in particular transport and installation problems due to the achievable hose guides for the respective inlet hose, are largely, preferably completely avoided. The development of the known dishwasher, in particular domestic dishwasher, also opens up the possibility of an improved system for unwanted but possibly occurring leaked water.

What is claimed is:

1. A dishwasher, comprising:

a wash container for items to be washed, said wash container configured to conduct at least water during operation;

a fluid line system having at least one inlet valve, said inlet valve having a center line and configured for direct or indirect connection of a water inlet line from a water supply network;

a base support disposed below the wash container and having a lower face, said base support having an outer wall provided with a cutout; and a support part securing the at least one inlet valve and configured for locking in the cutout, said support part having at least one externally open locking holder, into which the at least one inlet valve is lockable and secured therein non-movably in an axial direction, said at least one externally open locking holder being aligned in such a manner that the center line of an inlet of the inlet valve runs at an angle of >0° and <90° in relation to the lower face of the base support, wherein the support part has a locking surface which runs obliquely upward and in which the at least one externally open locking holder is formed, and a collection surface which is provided below the locking surface of the support part and runs obliquely downward for collecting and draining leaked water from the inlet valve, wherein the collection surface of the support part has a collection region which is configured as an aperture to an inner discharge surface of the support part, and wherein the inner discharge surface of the support part has a discharge length sufficient to allow drainage of collected leaked water into an interior of the base support.

2. The dishwasher of claim 1, constructed in the form of a domestic dishwasher.

3. The dishwasher of claim 1, wherein the angle is ≥20° and ≤70°.

4. The dishwasher of claim 1, wherein the angle is ≥30° and ≤60°.

5. The dishwasher of claim 1, wherein the locking surface of the support part and the collection surface of the support part form an angle between 60° and 120°.

6. The dishwasher of claim 5, wherein the angle formed by the locking surface and the collection surface is between 80° and 100°.

7. The dishwasher of claim 5, wherein the angle formed by the locking surface and the collection surface is around 90°.

8. The dishwasher of claim 1, wherein the locking surface of the support part forms a backward projection projecting beyond a rear face of the support part.

9. The dishwasher of claim 1, wherein the collection surface of the support part has a forward projection projecting beyond a front face of the support part.

10. The dishwasher of claim 1, wherein the collection surface of the support part has at least in part a concave surface contour in a horizontal direction.

11. The dishwasher of claim 1, wherein the support part has a collection contour which encloses at least in part the collection surface of the support part.

12. The dishwasher of claim 11, wherein the collection contour is configured to enclose at least in part an outside of the collection surface of the support part.

13. The dishwasher of claim 11, wherein the collection contour is configured as a raised frame that projects from the collection surface.

14. The dishwasher of claim 1, further comprising a frame configured to enclose at least in part the locking surface of the support part and the collection surface of the support part and any adjoining surfaces of the support part, said frame having at least one locking contour for insertion into the cutout of the outer wall of the base support.

15. The dishwasher of claim 14, wherein the frame has a lower frame part provided with the locking contour and a further edge region having, at least in part, a stop contour for outside contact with the cutout of the outer wall of the base support.

16. The dishwasher of claim 1, wherein the at least one externally open locking holder of the support part has a top provided with an opening for receiving the inlet valve, said opening being bounded by an upper fixing contour and a lower stop contour for the inlet valve.

17. The dishwasher of claim 16, wherein the upper fixing contour and the lower stop contour have each a yielding configuration.

18. The dishwasher of claim 16, wherein the support part has a second externally open locking holder, and further comprising a panel configured for insertion in the second externally open locking holder of the support part during production of the support part.

19. The dishwasher of claim 18, wherein the panel is injected in with a material fit in the second externally open locking holder of the support part.

20. The dishwasher of claim 1, wherein the support part is configured to secure two of said at least one inlet valve of the fluid line system for allowing the direct or indirect connection of at least one water inlet line from the water supply network.

21. A dishwasher, comprising:

a wash container for items to be washed, said wash container configured to conduct at least water during operation;

a fluid line system having at least one inlet valve, said inlet valve having a center line and configured for direct or indirect connection of a water inlet line from a water supply network;

a base support disposed below the wash container and having a lower face, said base support having an outer wall provided with a cutout; and a support part securing the at least one inlet valve and configured for locking in the cutout, said support part having at least one externally open locking holder, into which the at least one inlet valve is lockable and secured therein non-movably in an axial direction, said at least one externally open locking holder being aligned in such a manner that the center line of an inlet of the inlet valve runs at an angle of >0° and <90° in relation to the lower face of the base support, wherein the support part has a second externally open locking holder, and further comprising a cover part configured for locking in the second externally open locking holder of the support part and having at least one edge-side U-shaped groove for engagement with fixing contours disposed on opposite sides of the second externally open locking holder and with a stop contour of the second externally open locking holder.

22. A dishwasher, comprising:

a wash container for items to be washed, said wash container configured to conduct at least water during operation;

a fluid line system having at least one inlet valve, said inlet valve having a center line and configured for direct or indirect connection of a water inlet line from a water supply network;

a base support disposed below the wash container and having a lower face, said base support having an outer wall provided with a cutout; and a support part securing the at least one inlet valve and configured for locking in the cutout, said support part having at least one externally open locking holder, into which the at least one inlet valve is lockable and secured therein non-movably in an axial direction, said at least one externally open locking holder being aligned in such a manner that the center line of an inlet of the inlet valve runs at an angle of >0° and <90° in relation to the lower face of the base support, wherein the support part has a second externally open locking holder so that the support part is configured to secure two of said at least one inlet valve of the fluid line system, and further comprising a vertical web provided between the at least one externally open locking holder and the second externally open locking holder of the support part for securing the two inlet valves, said web projecting into a main plane of a front face of the support part.

23. The dishwasher of claim 22, wherein the web is centrally aligned between the at least one externally open locking holder and the second externally open locking holder of the support part.

* * * * *